US009555933B2

(12) United States Patent
McKenna et al.

(10) Patent No.: US 9,555,933 B2
(45) Date of Patent: Jan. 31, 2017

(54) SYNTHETIC BOTTLE CLOSURE

(75) Inventors: Conor McKenna, Unley (AU); John Brooks, Leabrook (AU)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 12/902,835

(22) Filed: Oct. 12, 2010

(65) Prior Publication Data

US 2011/0024383 A1 Feb. 3, 2011

Related U.S. Application Data

(63) Continuation of application No. 10/507,626, filed as application No. PCT/AU03/00189 on Feb. 17, 2003, now abandoned.

(30) Foreign Application Priority Data

Feb. 15, 2002 (AU) ..... PS0532

(51) Int. Cl.
*B65D 39/04* (2006.01)
*B65D 39/00* (2006.01)
*B65D 51/18* (2006.01)

(52) U.S. Cl.
CPC ..... *B65D 39/0023* (2013.01); *B65D 39/007* (2013.01); *B65D 51/18* (2013.01)

(58) Field of Classification Search
CPC .... B65D 39/0023; B65D 51/18; B65D 39/007
USPC ..... 215/358, 354, 254, 294, 273, 355, 320
See application file for complete search history.

(56) References Cited

U.S. PATENT DOCUMENTS

| | | | | |
|---|---|---|---|---|
| 1,747,760 | A * | 2/1930 | Duffy et al. | 215/320 |
| 3,831,798 | A * | 8/1974 | Rowe | B65D 25/32 215/256 |
| 4,109,816 | A * | 8/1978 | Faulstich | 215/256 |
| 4,342,400 | A * | 8/1982 | Llera | 215/256 |
| 5,060,813 | A * | 10/1991 | Gollasch et al. | 215/329 |
| 5,603,422 | A * | 2/1997 | Herrmann | B65D 41/3447 206/807 |
| 5,626,251 | A * | 5/1997 | Luburic | B65D 43/0256 215/256 |
| 2005/0035081 | A1 * | 2/2005 | Fitch | B65D 55/0854 215/246 |

* cited by examiner

*Primary Examiner* — James N Smalley
(74) *Attorney, Agent, or Firm* — The Watson IP Group PLC; Jovan N. Jovanovic; Vladan M. Vasiljevic

(57) ABSTRACT

There is a closure 1, which is, in this case, shown as closing a mouth 2 of a bottle 3, wherein the bottle is made of glass and has an external outwardly extending integral collar 4 which extends fully around an outside of the neck of the bottle and is of a constant shape and size at any location around the periphery. The seal 5 is held under compression against an uppermost rim 6 of the bottle mouth 2 and surface 7, which is adapted to engage with compression force the seal 5. Upon extraction of portion 8 from within the mouth of the bottle, a "popping" sound is achieved by having the position of the seal somewhat below the mouth prior to extraction so that there will be upon extraction an evacuation of the headspace within the bottle.

22 Claims, 9 Drawing Sheets

SYNTHETIC BOTTLE CLOSURE

CROSS-REFERENCE TO RELATED APPLICATIONS

This is a Continuation application of U.S. patent application Ser. No. 10/507,626, with a filing date of Jul. 15, 2005, which was filed under 35 U.S.C. 371 as a national stage of International Application No. PCT/AU03/00189, with a filing date of Feb. 17, 2003, an application claiming foreign priority benefits under 35 U.S.C. 119 of Australian Application No. PS 0532, with a filing date of Feb. 15, 2002, the content of each of which is hereby incorporated by reference in its entirety.

TECHNICAL FIELD

This invention relates to a closure particularly of a type appropriate for closing bottles.

BACKGROUND ART

The problem to which this invention relates will be illustrated by reference to bottles of a type used to conventionally store wine but it is not intended that, at least in its broadest sense, the invention should be restricted to only this application.

> "It can be argued that closing the bottle remains one of the greatest technical issues facing the wine industry. The winemaker can control many aspects of wine production to create a wine suitable for the marketplace, and yet there can be an unpredictable incidence of problems once the wine is bottled, due in large part to the properties of the closure used".
>
> Peter Godden & Leigh Francis, The Australian Wine Research Institute, June 2001, Australian Journal of Grape and Wine Research, Volume 7, Number 2, 2001.

It is currently known how to use the material natural cork to close the top of a wine bottle.

Despite being produced from an inherently variable natural product, natural cork has the advantageous characteristic of having an appropriate resiliency so that it can be used to tightly close a bottle top by being inserted inside the mouth in such a way that it will then effect substantial expansion against the inner surface of the bottle mouth to form a liquid and gas seal.

However, a very serious problem exists which is that natural cork is vulnerable to infection such as that caused by trichloroanisoles (TCA) and if an infected cork is used the infection has the probability of affecting the wine and, in more serious cases, seriously tainting the wine.

Estimates of as many as one in ten bottles of wine closed by cork might be affected in this way.

There are additional problems caused by the inconsistencies in the physical properties of natural cork, which can cause random bottle oxidation, seepage and leakage, breakage or cracking during insertion, excessive dust and inconsistent application of surface coating materials. Other problems are regularly encountered, such as crumbling and breaking over time, which becomes obvious at extraction.

The general inconsistency of cork as a closure has driven the development of alternative closures that are manufactured from materials other than natural cork.

Synthetic plugs and metallic screw caps have been developed as alternative closures, but these have not gained the same acceptance as natural cork.

Two general types of alternative closures illustrate the attempts and current difficulties being experienced, in terms of performance and public acceptance.

One attempt has been the manufacture of cylindrical plugs moulded or extruded from synthetic materials that are inserted and extracted in the same manner as traditional cork.

Significant difficulties forming an acceptable seal with foamed plastic may arise from its physical characteristics resulting in problems with flavor scalping, gas transmission and high extraction forces.

This leads to the further difficulty then that conventional extraction might be excessively difficult in some cases for a consumer or, in other cases, the closure would not be sufficient to maintain an adequate seal over a longer period to maintain the integrity of the wine inside the bottle.

Another attempt is the metallic Roll On Pilfer Proof (ROPP) or Roll On Tamper Evident (ROTE) screw cap closure, also referred to under the Trade Mark "Stelvin".

This approach includes a metal cap which is rolled into a screw thread outside a bottle neck and is able to hold under compression therefore a gasket or seal between an underneath surface of the top of the cap and the top rim of the mouth of the bottle.

This "Stelvin" type closure has been found to provide in the opinion of many the best long term seal to maintain the integrity of the product within the bottle.

There is however a problem with the public acceptance of this type of closure.

PROBLEM ADDRESSED BY THIS INVENTION

An object of this invention is to provide a closure which will offer an alternative to the current closures and achieve acceptable sealing qualities so that the technical problem of closing the bottle without spoiling the wine can be overcome in a manner that results in an improved public acceptability of closures in accord with this invention.

DISCLOSURE OF THE INVENTION

According to one form of this invention there is proposed a bottle closure where the bottle is of a type having a mouth to be closed, the closure having a body having an outer surround adapted to snap on to and engage with an interlocking fit, an outwardly extending integral collar of the neck of the bottle, a seal adapted to be held under compression against an uppermost rim of the bottle mouth, and a portion of the body adapted to be located within the mouth of the bottle and, at least during extraction, to effect a seal with the inner surface of the mouth of the bottle.

By having a portion of the body inside the mouth of the bottle that will engage with some sealing effect ensures a "popping" sound when being extracted.

In this way, there can be provided both the attraction of causing a so-called "popping" sound when the body is extracted from the bottle while, at the same time, there can be provided a substantial seal which can be held under compression over a longer period by having this interlocking engagement with the outer integral collar of a bottle which already exists in bottles of common manufacture.

In preference, the body is made from plastics material.

In preference, the interlocking fit is effected by an inwardly directed lip engaging a lower edge of the integral collar of the bottle.

In preference, the inwardly directed lip is attached to a remainder of the body by means which are adapted so that the lip can be manually torn from the remainder of the body whereby to remove the interlocking effect.

In preference, the inwardly directed lip is provided by a tear away strip.

In preference, the inner portion of the body provides an outer surface which is provided by a thin wall such that there can be effected substantial resilience to maintain a sealing engagement with the inner surface of the mouth of the bottle thereby.

One of the difficulties with bottles, especially of the type used for storage of wine, is that the outside dimensions are able to be defined by the mould in which the glass is formed but the inner surface is not able to be closely gauged.

In practice, this means that an inner part of the mouth just below the rim can be within a reasonably close tolerance of size but below this, there is a much greater range for possible sizes, which are generally specifically indeterminate.

In accordance with this invention, the advantage is to provide the familiar "popping" sound and this is achieved by ensuring that at least during some of the extraction of the closure, there will be caused a sufficient sealing so as to cause a temporary reduction in the pressure of gas above liquid within the bottle and therefore effect a sudden release of this when the inner portion of the closure breaks clear from a sealing engagement within the mouth of the bottle.

In a further alternative form of the invention, this resides in the combination of a closure according to any of the preceding features in combination with a bottle of the type described.

In preference, the bottle is of glass.

In preference, in relation to a bottle closure there is an additional provision that there can be a seal comprised of at least in part a material providing substantial resistance to the passage of oxygen there through, thereby offering the closure the propensity to retain free SO2 concentration in the bottle thereby prolonging the integrity of the wine.

In preference, the seal is of a form and position as a part of the closure such that it will extend substantially across the mouth of the bottle when the closure is in the closure position in respect of a bottle so as to provide thereby at least substantial resistance of oxygen passage there past or there through.

In preference, the bottle closure is first characterised in that the body is comprised of at least two parts which are assembled together with a seal held between the two parts where one of the parts is comprising the portion of the body adaptably located within the mouth of the body.

In preference, in one case, the two parts are joined by a metal means projecting mutually through the respective parts.

In a further preferred arrangement, the two parts are joined by at least one plastic finger extending through the seal.

These and other features can be additionally discerned from the following description and claims appended to this specification.

In a further alternative form of the invention, this can be said to reside in the method of closure of a bottle which includes the steps of inserting a closure according to any one of the above features into a bottle including forcing the inwardly directed lip to ride over and behind the edge of the integral collar so that this will, in this position, effect substantive compression of a seal between the body of the closure and an uppermost edge of the rim of the bottle.

This then provides for a snap-on feature where the closure can be placed in position on a bottle by simply pushing the closure with sufficient force over the mouth to an extent that there will be then the interlocking effect. By having significant "give" provided by a thickness of substantial resilient material, the position of the closure can in fact be passed the mere interlocking fit position to ensure that it will in every occasion in a practical application provide an interlocking effect, but the depth of resilient material will ensure sufficient pull back while maintaining sufficient closure pressure with respect to the rim of the mouth of the bottle.

In trials conducted thus far such a depth of resilient material is twice that of the depth which is used in a conventional "Stelvin" closure. A "Stelvin" closure is positioned and secured on to a bottle having an external screw thread into which it is rolled.

In preference, the body includes means adapted to receive a further member.

In preference, such a further member can include a projecting portion extending into the inner portion of the body so as to be supported thereby and including a further part or parts providing visually attractive features.

BRIEF DESCRIPTION OF THE DRAWINGS

For a better understanding of this invention it will now be described in relation to a preferred embodiment which shall be described with the assistance of drawings wherein.

BEST MODE FOR CARRYING OUT THE INVENTION

Figure 1:
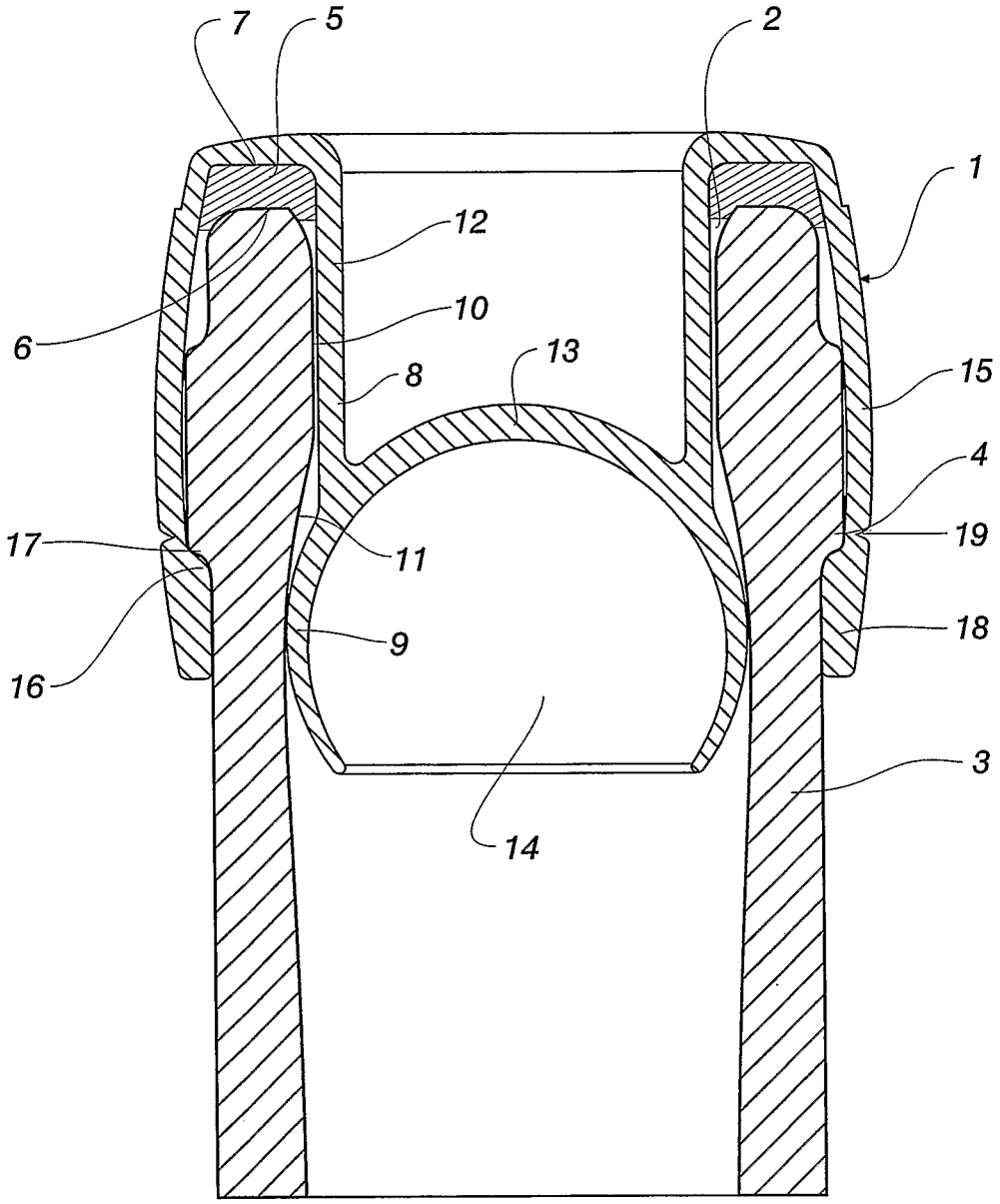
FIG. 1 is a cross-sectional view of a closure according to the first embodiment when in position on the top of a bottle.
Figure 2:
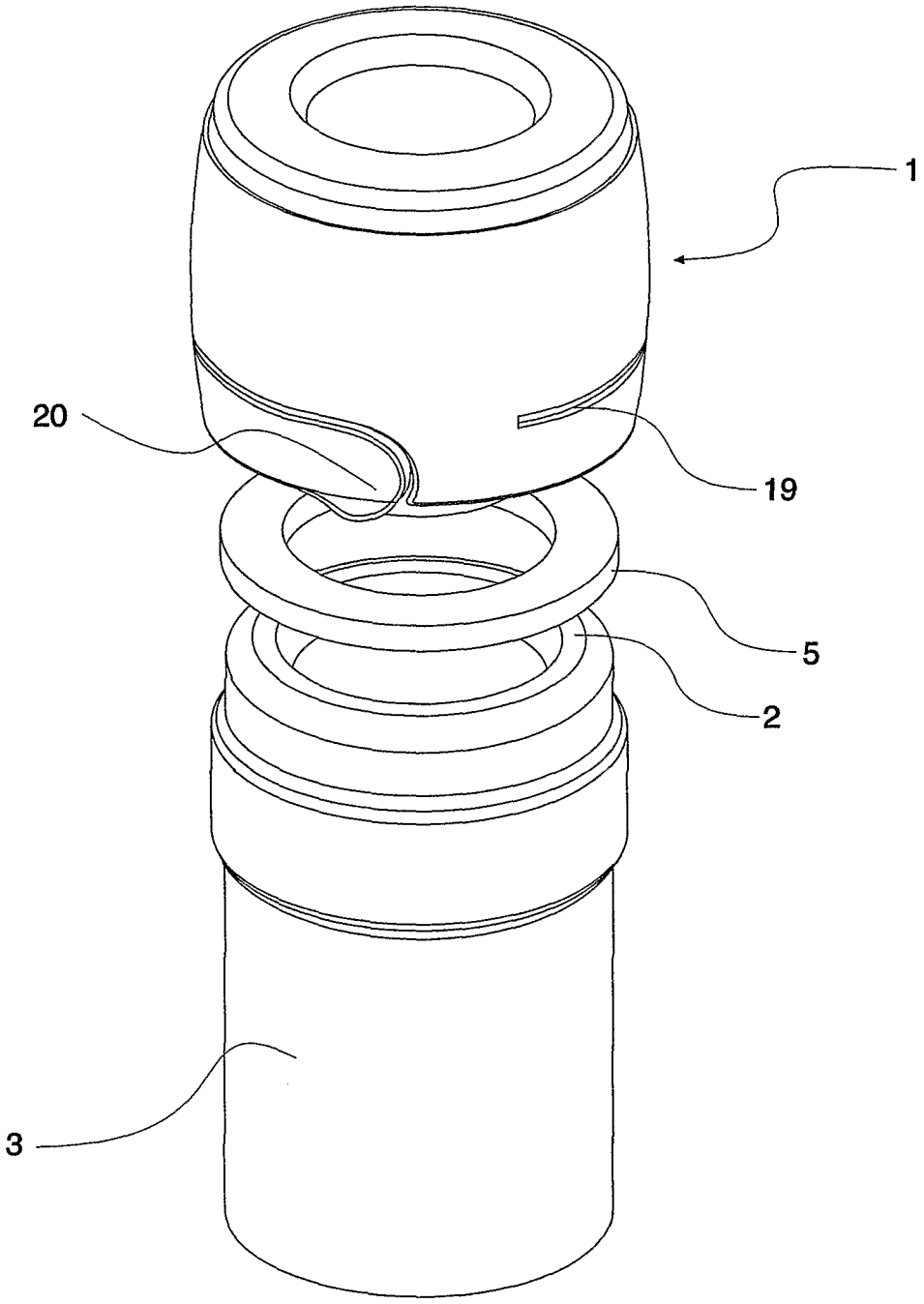
FIG. 2 is an external perspective view as an exploded view of the closure according to the first embodiment together with a seal and underneath a representation of the top of the bottle.

Now referring to the drawings in details and, in particular, the first embodiment as illustrated in FIGS. 1 and 2.

In this case there is a closure 1, which is, in this case, shown as closing a mouth 2 of a bottle 3.

The bottle is made of glass and has an external outwardly extending integral collar 4 which extends fully around an outside of the neck of the bottle and is of a constant shape and size at any location around the periphery.

This is a conventional feature of a number of existing bottles but is in distinction of a screw thread shape, which is the requirement for a "Stelvin" type closure.

There is a seal 5 held under compression against an uppermost rim 6 of the bottle mouth 2 and surface 7, which is adapted to engage with compression force the seal 5.

There is a portion 8, which is located within the mouth of the bottle 3.

This portion includes a bulbous section 9 which is provided by a thin wall section of plastics material given that the closure generally is made from plastics material, such that when the thin wall of the bulbous section 9 is compressed as when it passes through the narrower section 10 of the bottle 3, then it will internally compress and effect sufficient compression to effect a sealing with the inner sides of the bottle neck during an extraction process. A "popping" sound is achieved by having the position of the seal somewhat below the mouth prior to extraction so that there will be upon extraction an evacuation of the headspace within the bottle. The depth of the bulbous portion in this embodiment is approximately 25 millimeters.

This sealing effect will also conventionally apply when the portion 8 is inserted within the mouth 2 but it will depend upon the tolerance of the inner surface 11 of the bottle mouth so that if this is a little larger, then as shown in the drawings, there might not be contact during storage although when it is extracted, there will be this sealing to effect a "popping" sound.

The shape of the thin wall bulbous section 9 is shown, so as to be supported by a cylindrical part 12 and an arcuate portion, which together then defines a concave area 14.

An outer surround 15 engages with interlocking fit by having an inwardly extending lip 16, the outwardly extending lowermost step 17 of the collar 4.

In this way, by insertion of the closure 1 over the bottle mouth, this will be inserted to the extent that there is caused this interlocking fit and the tolerance of the seal 5 is such that this will be caused to effect the seal by reason of this extent of compression.

For removal of the closure from a bottle, there is provided a detachable strip shown at 18, which is secured to a remainder of the body of the closure 1 by a weakened portion at 19 which substantially surrounds, but not totally, the surround 15.

An extended tab 20 provides for a first location and pull tab position which then assists in a consumer sufficiently removing this tear off tab portion so that there will be either negligible or no resistance to then subsequent removal by reason of any interlocking fit.

Such a tearable strip shall be attached to the main body of the closure with sufficient strength so that it will be able to retain the seal 5 under compression over a substantial period of time.

However, it will be sufficiently tearable so that even a relatively weak adult may be able to adequately grasp the pull off tear tag and pull this away to release the closure from an interlocking fit.

There are techniques known to provide such a characteristic and with experiment, this can be achieved with this particular example.

The body is intended to be manufactured by injection moulding from plastics material where the plastics material, being in contact with product within a bottle will be of a food grade character.

A characteristic of this embodiment is that then there is provided a snap-on closure, which then provides a very substantive sealing effect while also providing a "popping" sound when being removed.

In relation to the second embodiment, the purpose for this is to provide a cap that will cover the closure but which can be lifted to expose the tear away tab.

Accordingly, the functional features of the bottle shown at 30 including a mouth 31 and an inner engaged surface 32, a compression seal 33 and a plastics body 34 are the same as in the first embodiment.

The difference, however, is that there is a further outstanding step at 35 which firstly is adapted to act with inwardly extending protrudence 36 and inwardly extending step 37.

There is further an inward projection at 38, which fills the cavity 39, which is the same cavity as shown in the first embodiment.

Figure 3:
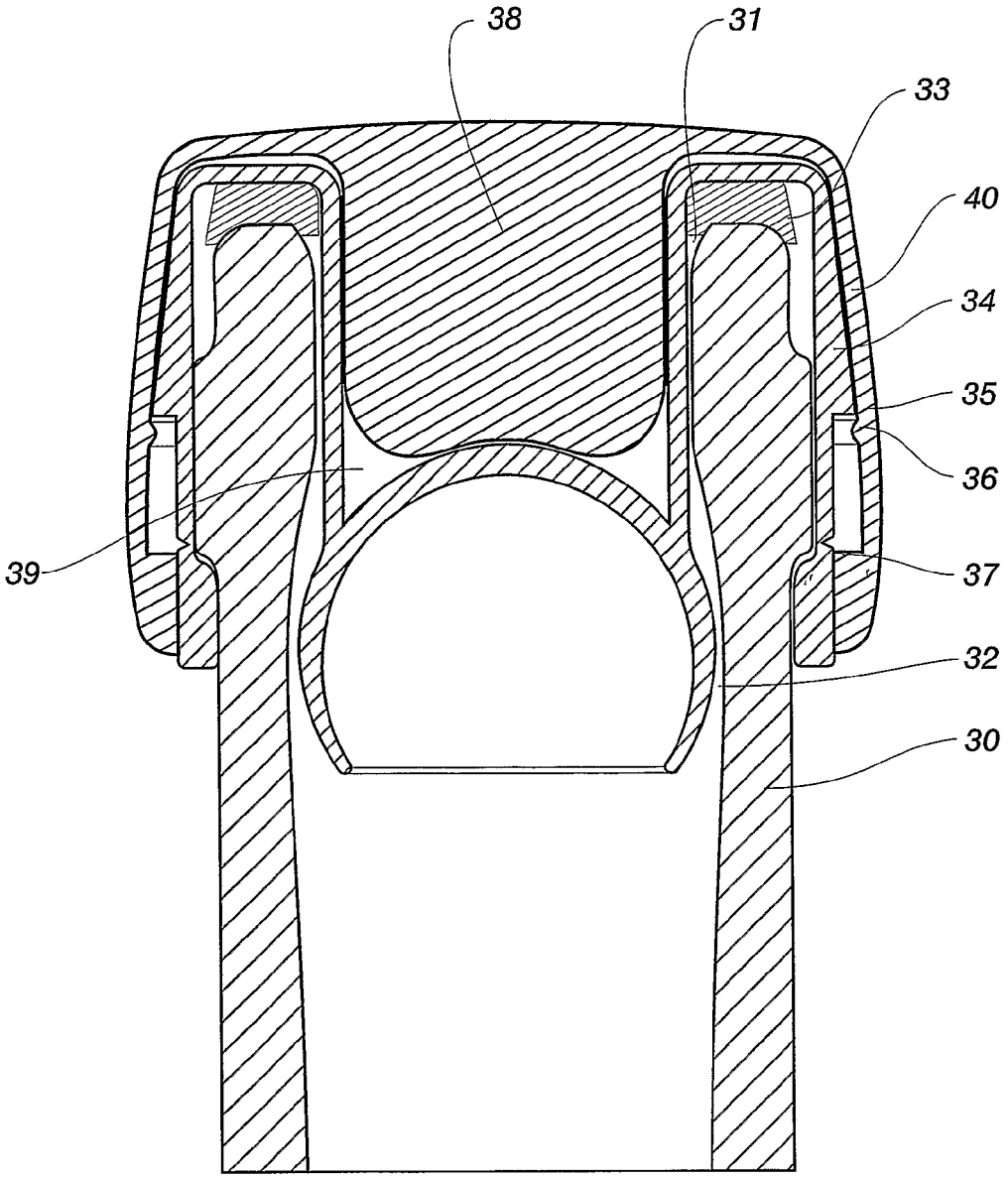
FIG. 3 is a second embodiment where the cross-sectional view, in this case, is again of the closure when in position on the top of a bottle and holding a seal under pressure with the addition, however, of an external cap.
Figure 4:
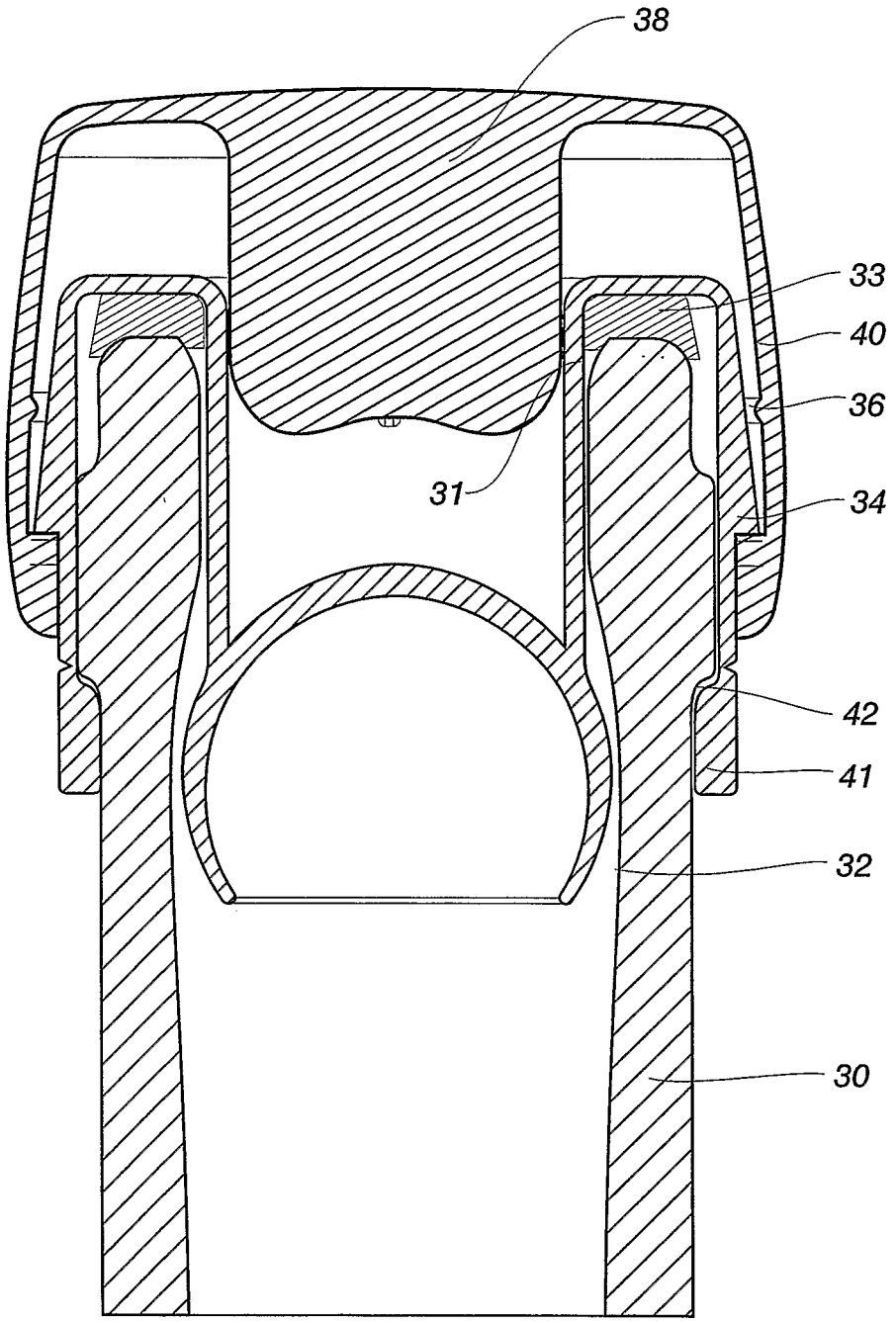
FIG. 4 is the same view as in FIG. 3 except, in this case, the cap is lifted relative to a closure.
Figure 5:
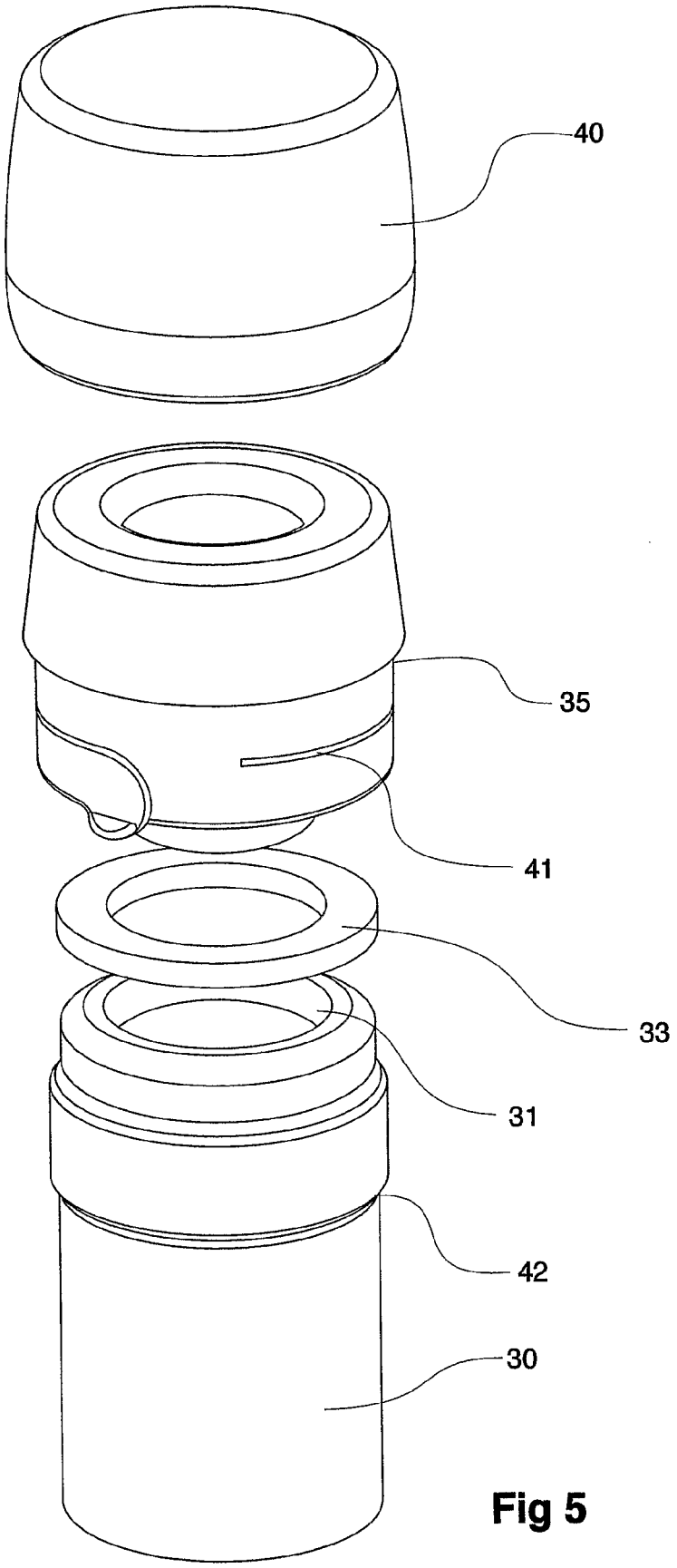
FIG. 5 is an external perspective view of the elements as in the second embodiment exploded, together with a representation of the top of a bottle at the bottom.
Figure 6:
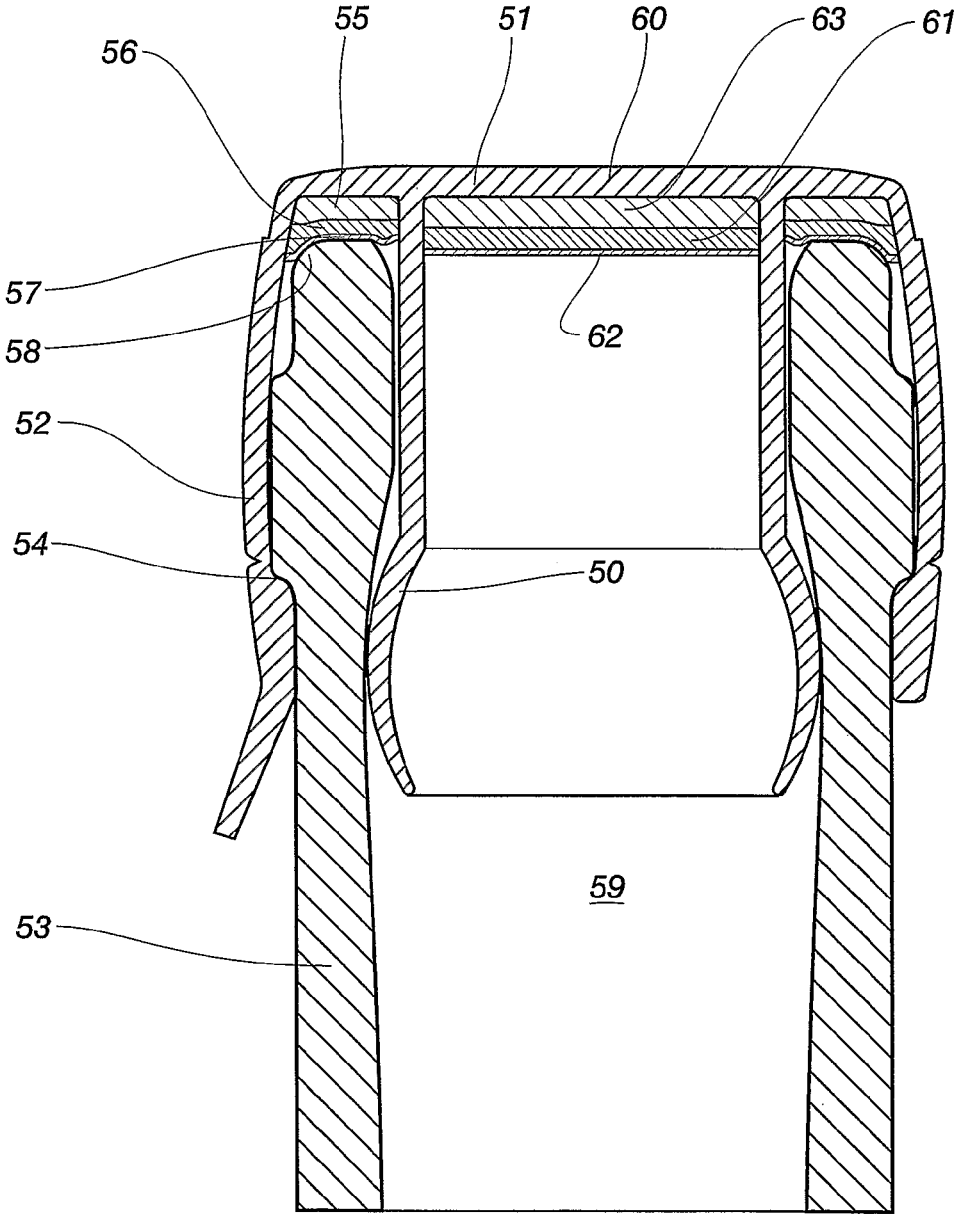
FIG. 6 is a cross sectional view of a third embodiment as positioned in a sealing position on the top of the bottle with an additional sealing member held between the two walls providing an inwardly projecting portion.

The advantage of this arrangement now is that the cap 40 can be made in any decorative form and support any labeling and is such that when the closure 34 is to be accessed for removal, a first step is to lift the cap 40 to a position as is shown in FIG. 4 from FIG. 3.

This then exposes the tear away tab and strip 41, which is effectively interengaging with the step 42 to provide an interlocking fit and hold down the compression seal.

While the cap, in this case, is shown with a level top, this can include extended tops or any decorative finish appropriate to the application but also to enable quick recognition of a particular brand where the extension may be in the form of a particularly well-recognized logo.

This cap conventionally would also be manufactured from plastics material by injection moulding.

Now referring to the third embodiment, the difference here is that there is an inwardly projecting part 50 which is integrally moulded as part of the total body 51 where there is also an outer surround 52 which is intended to be located on top of the bottle 53 by engagement of an inwardly directly step 54 to hold the body 51 in such a closing position.

One of the features of this arrangement is that there is additional resiliency within an annular wad 55 which holds a material, in this case an aluminium foil 56 with an outer coating 57 of appropriate plastics material against the uppermost rim of the mouth of the bottle 53.

However, this would ordinarily therefore leave access to gas within the space 59 to allow possible permeation of the body of the plastics material at 60.

In order to ensure that the closure provides an additional seal against the gas passage such as for instance oxygen, there is inserted in this case then a substantially non permeable sheet 61 which is held by friction between the downwardly projecting wall 50 where there is also a lowermost coating surface 62 and an uppermost foam material providing additional resiliency at 63.

This still leaves some possible permeability through the thin wall 50 through the vertical passage for gas through this wall although this would be no where near as permeable as the otherwise open area of the top of the body at 60.

Figure 7:
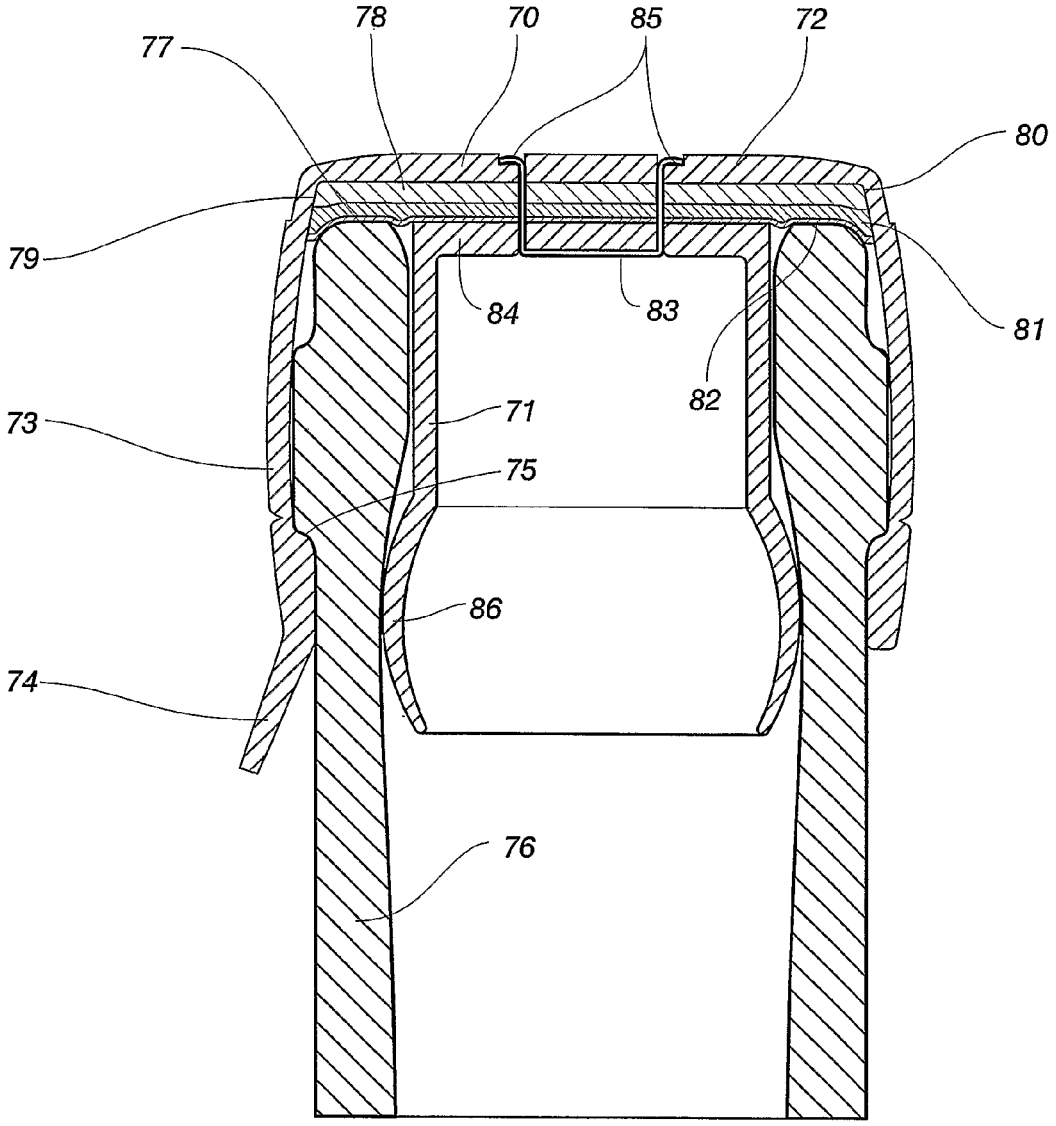
FIG. 7 is a cross sectional view of a fourth embodiment also in a closing position on the top of the bottle.

Accordingly, there is advantage in a further arrangement, which is shown in the fourth embodiment, FIG. 7.

In this case, the body 70 is assembled from previously separable parts and there is an inwardly projecting part 71, a top 72 and an outwardly extending surrounding part 73.

This outwardly surrounding part 73 also includes a tear away portion 74 which includes sufficient part of the inwardly directed step at 75 so that when the tear away part is torn away, this will allow at least reasonable removal of the body 70 from the closing position as shown.

In this case then the bottle 76 has its upper most mouth defined by the tops at 77 but in this case, there is a substantially resilient wad 78 which extends fully from side 79 to side 80 and has in front of it the sheet 81 which is made from an impermeable metal in this case aluminium, and there is an underneath plastics coating, in this case PVDC, on this at 82.

The problem faced here however is that all of these members need to be able to be joined together in a way that will not therefore substantively prejudice the sealing quality of the metal sheet 81, but at the same time be able to be incorporated economically.

In this case, there is provided a staple 83, which is passed through a transverse top part 84 of the downwardly projecting part 71 and the staple has its ends outwardly turned at 85.

This then ensures that all of the components are held together and where the staple passes through the metal of the gas barrier material 81, this would be expected to be a very tight fit and as such allow for only very minimal gas passage thereby.

As with the other cases, the downwardly projecting part 71 includes a lowermost bulbous part 86, which allows for a resilient bearing surface.

This embodiment therefore again as with others combines both the possibility of location of the cap simply with a snap on fit and by having the necessity of a tear away strip to allow removal, therefore provides a snap-on tamper evident (SOTE) or a snap-on pilfer proof (SOPP) closure, which together provides effective sealing to a level which is similar to that provided by such closures as the roll-on tamper evident (ROTE) or the roll-on pilfer proof (ROPP) screw-cap closures, such as the "Stelvin" closure.

Figure 8:
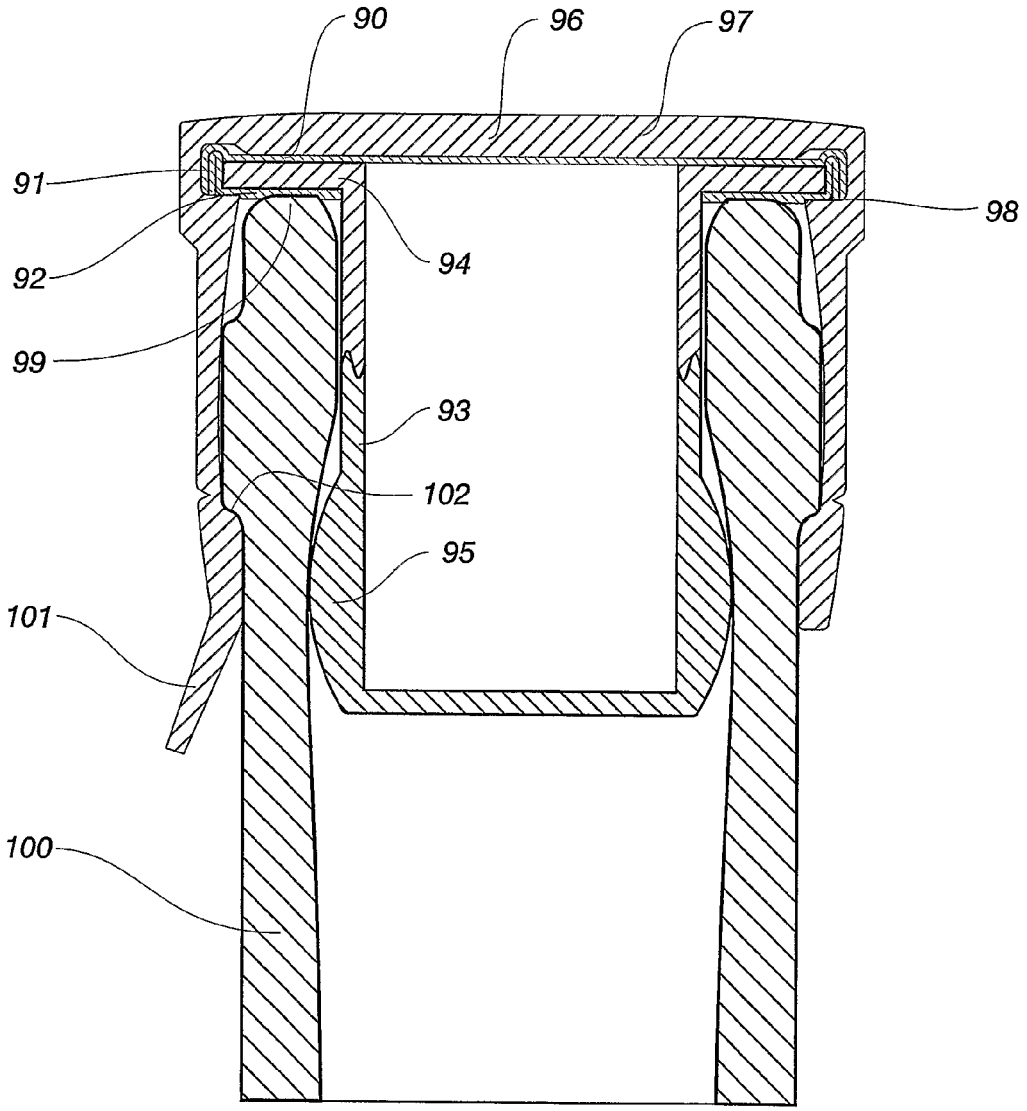
FIG. 8 is a cross sectional view of a fifth embodiment also again shown in a closing position on the top of the bottle.

Now referring to the fifth embodiment as shown in FIG. 8, the seal in this case is effected by having a continuous sheet at 90 which being circular is welded at its periphery shown at 91 to a further annular sheet 92.

This join 91 is such that this forms a gas resistant join and in this case the centrally projecting portion at 93 is co-moulded so that there is a soft resilient part at 95 and a harder part 94.

Otherwise, this closure, which is generally shown at 96, includes a body 97, which includes an inwardly directed step at 98 so as to support the downwardly projecting part 93 and at the same time hold together the metal sheets with respect to the top rim 99 of the bottle top 100.

This embodiment further includes the other features described in the other embodiments which is to say a tear away strip such as at 101 which allows for subsequent removal of the body 97 from inter engagement with the outwardly directed step 102 of the bottle top 100.

Figure 9:
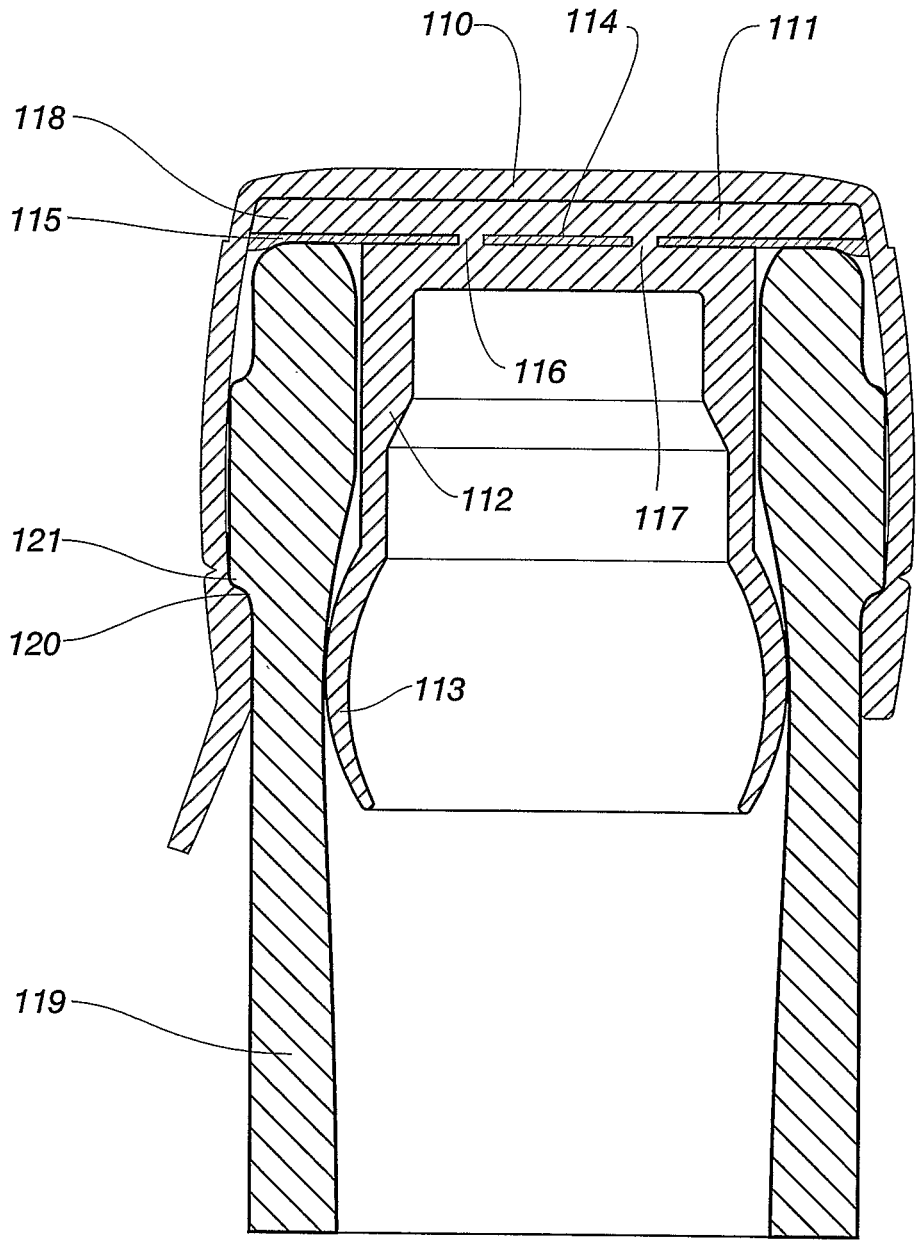
FIG. 9 is a cross sectional view of a sixth embodiment.

Now referring to the sixth embodiment, as shown in FIG. 9, which has a further sealing arrangement.

In this case, the body 110 is adhering to a further integrally moulded part 111, which has supported therewith a downwardly projecting portion 112, which includes a lowermost bulbous portion 113, which extends into the bottle, as is the case with all of the other instances.

The advantage of this extension is that it does assist in providing a somewhat similar extraction of any air or gas within the top of the bottle so as it is released, there is a "popping" sound similar to that provided when a cork is pulled out.

In this case, there is a gas resistant sheet at 115 where the plastics material of this part 111 passes through aperture 116 in one instance and 117 in the other.

This again then has a resilient upper surface material at 118 which therefore allows firstly for the cap when pushed onto the top of the bottle 119 to be pushed past an interlocking position with the inwardly directed step 120 interlocking with the outwardly directed step of the bottle 119, namely 121, where after the resiliency of the material 118 will then re-assert a sealing pressure and maintain this sealing effect so as to resist a build up of pressure in the vacuity (headspace) between the closure and the wine.

Throughout this specification there has now been described both a simple apparatus and a more complex apparatus in various embodiments, which in each case provides for a centrally projected part which projects substantially into the top of the bottle.

One of the features of the arrangement described is that in each case they are appropriate to be used in conjunction with a capsule. Such capsules are conventionally used in the wine industry although not exclusively and maybe of lead, aluminium or more recently extruded sheet plastics material. Where these are used in conjunction with the tear away strip it is of advantage that access to this can either be visually seen or can be available through an aperture through the capsule.

In consideration of the slightly wider shape provided by the outer surround in this invention, a capsule should be able to be constrained beneath the closure so that for instance, if a plastics material were used for the capsule, a shrink wrap effect could be used. Alternatively, with metal foil, this could be rolled into the more compact location around a bottleneck.

An application for these closures is predominantly for materials such as wine where there is value in the celebratory aspect of the material and its access.

The invention claimed is:

1. A bottle closure for a bottle where the bottle is of a type having a mouth to be closed, the bottle closure comprising: a body having an outer surround adapted to engage an outwardly extending integral collar of the neck of the bottle, which integral collar of the neck is spaced apart from an uppermost rim of the bottle, a seal adapted to be held under compression by the body against an uppermost rim of the bottle mouth, and a portion of the body adapted to be located within the mouth of the bottle and, at least during extraction, to effect a seal with an inner surface of the mouth of the bottle, the interlocking fit being effected by an inwardly directed lip adapted to engage a lower edge of the integral collar of the bottle, wherein the inwardly directed lip continuously surrounds the body of the closure, the seal being comprised of at least in part a material providing substantial resistance to the passage of oxygen there through, wherein the seal is of a form and positioned as a part of the closure such that it will extend substantially across the mouth of the bottle and the uppermost rim of the bottle mouth when the closure is in a closure position in respect of a bottle so as to provide thereby at least substantial resistance of gas passage there past or there through to prevent permeability of gas passage through the body of the closure, and wherein the inwardly directed lip is provided by a detachable tear away strip and is attached to a remainder of the body such that the lip can be manually separated from the remainder of the body and from the bottle whereby to reduce the interlocking effect to allow for subsequent removal of the closure from a closure position in relation to the bottle, and wherein the detachable tear away strip is attached to the remainder of the body of the closure by a weakened portion that substantially surrounds the body of the closure and includes a first location that intersects the inwardly directed lip with a large radius so that, when the closure is placed in position on the bottle, the inwardly directed lip can be forced to ride over and engage the lower edge of the integral collar of the bottle to retain the seal under compression and so that the detachable tear away strip is sufficiently tearable, while the weakened portion extends over the outer surface of the integral collar of the bottle in an engaged configuration so as to be positioned below the uppermost rim of the bottle with a portion of the outer surround extending over the outer surface of the integral collar between the weakened portion and the seal with the inwardly directed lip extending inwardly beyond an innermost portion of the weakened portion.

2. A bottle closure as in claim 1, wherein the body is comprised of at least two parts which are assembled together with the seal held between the two parts where one of the parts is comprising the portion of the body adapted to be located within the mouth of the bottle.

3. A bottle closure as in claim 2, wherein the body is an assembly where the portion of the body adapted to be located within the mouth of the bottle is attached to a portion of the body by connecting means.

4. A bottle closure as in claim 2, wherein the two parts are joined by a metal means projecting mutually through the respective parts.

5. A bottle closure as in claim 2, wherein the two parts are joined by at least one finger of plastics material extending through the seal.

6. A bottle closure as in claim 1, wherein the inner portion of the body provides an outer surface which is provided by a thin wall such that there can be effected substantial resilience to maintain a closure, to afford, upon being withdrawn, a sealing engagement with the inner surface of the mouth of the bottle thereby.

7. A bottle closure as in claim 2, wherein the two parts are joined by a metal staple.

8. A bottle closure as in claim 1, wherein the closure has the body providing a projecting portion of the body, adapted to be located substantially into the mouth of the bottle, moulded as integral one with the other.

9. A bottle closure as in claim 1, wherein the portion adapted to be located within the mouth of the bottle is of a shape where there is a bulbous end provided by a thin wall of plastics material.

10. A bottle closure as in claim 1, wherein the portion adapted to be located within the mouth of the bottle is of a shape and length such that when extracted from a selected bottle with a selected quantity of liquid in the bottle that it can be expected to provide a popping sound.

11. A bottle closure as in claim 1, wherein the body is made from injection moulded plastics material.

12. The combination of the bottle and the bottle closure according to claim 1, wherein a centrally projected part projects substantially into the top of the bottle when in a closing position with respect to the mouth of the bottle.

13. The combination of the bottle and the bottle closure according to claim 1 wherein said closure is covered by a capsule.

14. A method of closure of a bottle which includes the steps of inserting a closure according to claim 1, into a bottle including forcing the inwardly directed lip to ride over and behind the edge of the integral collar and being arranged so that this will, in this position, effect substantive compression of a seal between the body of the closure and an uppermost edge of the rim of the bottle.

15. A method as in claim 14 wherein the body includes means adapted to receive a further member.

16. A method as in claim 15 wherein the further member includes a projecting portion extending into an inner portion of the body so as to be supported thereby and including a further part or parts providing visually attractive features.

17. A bottle closure as in claim 1, wherein the weakened portion has sufficient strength so as to retain the seal under compression against the uppermost rim of the bottle mouth when the closure is in the closure position.

18. A bottle closure as in claim 1, wherein the detachable tear away strip has an extended tab extending from the body of the closure adjacent the inwardly directed lip provided by the detachable tear away strip that substantially surrounds the body of the closure for assisting to detach the detachable tear away strip at the first location along the weakened portion.

19. A bottle closure as in claim 18, wherein the extended tab provides the first location of the weakened portion.

20. A bottle closure as in claim 1, wherein the relatively large radius of the weakened zone at the first location provides an angle of intersection with the inwardly directed lip of less than 45 degrees.

21. A bottle closure as in claim 1, wherein the detachable tear away strip is made from a resilient plastics material and the weakened zone of the detachable tear away strip is of sufficient thickness to ride over the lower edge of the integral collar of the bottle and be sufficiently tearable.

22. A bottle closure as in claim 1, wherein the detachable tear away strip forms the lowermost portion of the bottle closure.

* * * * *